US008691488B2

(12) United States Patent
Davis et al.

(10) Patent No.: US 8,691,488 B2
(45) Date of Patent: Apr. 8, 2014

(54) TONER PROCESS

(75) Inventors: Melanie Davis, Hamilton (CA); Kimberly Nosella, Mississauga (CA); Suxia Yang, Mississauga (CA); Daryl Vanbesien, Burlington (CA); Richard P. N. Veregin, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 64 days.

(21) Appl. No.: 13/434,833

(22) Filed: Mar. 29, 2012

(65) Prior Publication Data

US 2013/0260308 A1 Oct. 3, 2013

(51) Int. Cl.
*G03G 5/00* (2006.01)

(52) U.S. Cl.
USPC ..... 430/137.14; 430/108.1

(58) Field of Classification Search
USPC ..... 430/137.14, 108.1
See application file for complete search history.

(56) References Cited

U.S. PATENT DOCUMENTS 3,996,392 A * 12/1976 Berg et al. ..... 430/123.58
2005/0008961 A1* 1/2005 Takada et al. ..... 430/108.6

* cited by examiner

*Primary Examiner* — Mark A Chapman
(74) *Attorney, Agent, or Firm* — MDIP LLC

(57) ABSTRACT

The present disclosure describes a toner produced using a coalescing temperature lower than the melting point of a wax in the toner, quench cooling or both. The resulting toners can exhibit reduced dielectric loss and improved tribo charging.

17 Claims, No Drawings

TONER PROCESS

FIELD

Toners produced by reducing coalescing temperature (Tc) during the aggregation/coalescence (AC) process, which can show improved tribo charging and reduced dielectric loss; developers comprising said toner; devices comprising said toner and developers; imaging device components comprising said toner and developers; imaging devices comprising said developers; and so on, are described.

BACKGROUND

Pigments, dyes and colorants often comprise large and/or complicated chemical structures, such as, multiple and/or conjugated rings, which can have varied and/or unpredictable electronic properties. For example, black pigments can have high color density (coloring per unit weight), a high blackness degree and high light fastness. However, toners containing higher amounts of black pigment exhibit lower charging with high dielectric loss, both of which reduce transfer efficiency and degrade image quality. Black pigments can form conductive pathways through the toner particle.

Therefore, there remains a need to reduce the dielectric loss, and thus, improve charging to enable, for example, hyperpigmented toner.

SUMMARY

The present disclosure describes toner compositions produced by reducing coalescence temperature (Tc) in a toner forming process, which toners can exhibit reduced dielectric loss, improved tribo charging, improved transfer efficiency, improved mottle or combinations thereof.

In embodiments, a method of producing a toner is disclosed including combining a first amorphous resin, an optional second amorphous resin, an optional crystalline resin, an optional surfactant, a wax, optionally a shell, an optional pigment, and optionally one or more other pigments in a mixture to form particles, and optionally aggregating said particles. The particles can be coalesced at a temperature lower than the melting point of said optional crystalline resin and said wax; the coalesced particles can be quench cooled or both. The resulting toner can exhibit lower dielectric loss as compared to a toner produced similarly but coalesced at a temperature higher than the melting point of said crystalline resin and wax; not quench cooled; or both, for example, a toner that comprises a conductive colorant, such as a black pigment. The toner can comprise a reduced surface and/or bulk sodium ion content and concentration.

In embodiments, a process for the preparation of toner compositions including combining a first amorphous resin, an optional second amorphous resin, an optional crystalline resin, a surfactant, a wax, optionally a shell, an optional pigment, and optionally one or more other pigments in a mixture to form a particles, and optionally aggregating said particles. The particles can be coalesced at a temperature lower than the melting point of said optional crystalline resin and said wax; the particles can be quench cooled; or both, where lowering coalescing temperature and/or quench cooling can reduce dielectric loss by greater than about 50% as compared to toner similarly produced but at a higher coalescing temperature and/or not quench cooled.

In embodiments, toners of interest have lower bulk and/or surface sodium ion content, exhibit lower dielectric loss, can carry greater amounts of pigment, and combinations thereof.

DETAILED DESCRIPTION

I. Introduction

Core-shell particles with a shell of at least about 25% (based on dry toner weight) of, for example, an amorphous latex, can contain the core materials from reaching the surface of the toner particle, which can decrease toner charge. However, with increased pigment loading, for example by about 30% more as compared to toners having about 6% pigment (based on dry toner weight, for example), such as Nipex-35, such hyperpigmented toners and/or toners with conductive colorants exhibit much lower charging with higher dielectric loss, both of which may reduce transfer efficiency and degrade image quality. Shell loading can be increased to about 30% of total toner particle weight but still may be insufficient in preventing dielectric loss and thus, the toner continues to have poor charging.

The present methods reduce coalescence temperature (Tc) during, for example, an aggregation/coalescence (AC) process; employ a rapid or quench cooling of the emulsion following coalescence; or both, which can reduce toner dielectric loss by at least about 60%, at least about 50%, at least about 40%, at least about 30% as compared to toner produced using a coalescence temperature greater than the melting point of a crystalline resin and a wax, when present; where the reduction of temperature following coalescence is not rapid or quenched; or both, and can improve tribo charging without negatively affecting other benchmark evaluations (e.g., but not limited to, $2^{nd}$ transfer efficiency, mottle, image quality and the like). In embodiments, a toner of interest has a dielectric loss, calculated as known in the art or as taught herein, of from about 30 to about 90, from about 40 to about 80, from about 50 to about 70, and so on. In embodiments, the reduction in dielectric loss is less than about 70, less than about 65, less than about 60. Again, while not being bound by theory, by reducing Tc, by quench cooling or both, the flow of resins and wax in the toner may be reduced and thus, pigment is restricted from moving and pooling together, such as, at or near the surface of the particles thereby creating domains that are conductive, where such conductive domains may explain why the dielectric loss is higher. The process of interest enables producing toners with higher pigment loading (e.g., hyperpigmented toners) and shell loading, and with reduced dielectric loss, approaching that of non-hyperpigmented toners.

In embodiments, such toners produced by the methods as disclosed herein may be differentiated by one or more benchmark evaluation metrics (e.g., but not limited to, reduced dielectric loss, improved $2^{nd}$ transfer efficiency, improved mottle, improved parent B-zone q/m, reduced q/d variation magnitude, improved image quality, reduced toner surface sodium ion concentration, and the like) compared to toners not so produced. In embodiments, the bulk sodium ion content is reduced, for example, less than about 1100 ppm, less than about 1000 ppm, less than about 900 ppm, and so on. The surface sodium ion content also is reduced, for example, less than about 0.25 atom %, less than about 0.225 atom %, less than about 0.2 atom %.

Unless otherwise indicated, all numbers expressing quantities and conditions, and so forth used in the specification and claims are to be understood as being modified in all instances by the term, "about." "About," is meant to indicate a variation of no more than 20% from the stated value. Also used herein is the term, "equivalent," "similar," "essentially," "substantially," "approximating" and "matching," or grammatical variations thereof, have generally acceptable definitions or at the least, are understood to have the same meaning as, "about."

In the application, use of the singular includes the plural unless specifically stated otherwise. In the application, use of, "or," means, "and/or," unless stated otherwise. Furthermore, use of the term, "including," as well as other forms, such as, "includes," and, "included," is not limiting.

For the purposes of the instant disclosure, "toner," "developer," "toner composition," and "toner particles," can be used interchangeably, and any particular or specific use and meaning will be evident from the context of the sentence, paragraph and the like in which the word or phrase appears.

As used herein, "pH adjuster," means an acid or a base or buffer which may be used to change the pH of a composition (e.g., slurry, resin, aggregate, toner, and the like). Such adjusters may include, but are not limited to, sodium hydroxide (NaOH), nitric acid, sodium acetate/acetic acid, and the like.

As used herein, "hyperpigmented" means a toner having high pigment loading at low toner mass per unit area (TMA), for example, such toners may have an increased in pigment loading of at least about 25%, at least about 35%, at least about 45%, at least about 55% or more relative to non-hyperpigmented toners (e.g., toners having carbon black pigment loadings of 6% or lower). In embodiments, a hyperpigmented toner as used herein is any new formulation wherein the amount of pigment is at least about 1.2 times that found in a control or known toner, in embodiments, at least about 1.3 times, at least about 1.4 times, at least about 1.5 times or more pigment as found in control or known formulation. In embodiments, hyperpigmented comprises greater than about 7%, greater than about 8%, greater than about 9% pigment of the total toner particle dry weight.

II. Toner Particles

Toner particles of interest comprise a resin, such as, a polyacrylate resin, a polystyrene resin, a polyester resin and so on. A composition can comprise more than one form or sort of polymer, such as, two or more different polymers, such as, two or more different polyester polymers composed of different monomers. The polymer can be an alternating copolymer, a block copolymer, a graft copolymer, a branched copolymer, a crosslinked copolymer and so on.

The toner particle can include other optional reagents, such as, a surfactant, a wax, a shell and so on. The toner composition optionally can comprise inert particles, which can serve as toner particle carriers, which can comprise the resin taught herein. The inert particles can be modified, for example, to serve a particular function. Hence, the surface thereof can be derivatized or the particles can be manufactured for a desired purpose, for example, to carry a charge or to possess a magnetic field.

A. Components

1. Resin

Toner particles of the instant disclosure include a resin forming monomer suitable for use in forming a particulate containing or carrying a colorant of a toner for use in certain imaging devices. As known in the art, a range of monomers is known for producing toner. While the following discussion relates to polyester polymers, the methods of interest can be applied to any resin made by any method where there is a final incubation step to finish particles to the desired parameters as a design choice.

Generally, any suitable monomer or monomers are induced to polymerize to form a polyester resin or a copolymer. Any polyfunctional monomer may be used depending on the particular polyester polymer desired in a toner particle. Hence, bifunctional reagents, trifunctional reagents and so on can be used. One or more reagents that comprise at least three functional groups can be incorporated into a polymer or into a branch to enable branching, further branching and/or crosslinking Examples of such polyfunctional monomers include 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl)methane and 1,2,7,8-octanetetracarboxylic acid. Polyester resins, for example, can be used for applications requiring low melting temperature.

One, two or more polymers may be used in forming a toner or toner particle. In embodiments where two or more polymers are used, the polymers may be in any suitable ratio (e.g., weight ratio) such as, for instance, with two different polymers, from about 1% (first polymer)/99% (second polymer) to about 99% (first polymer)/1% (second polymer), in embodiments from about 10% (first polymer)/90% (second polymer) to about 90% (first polymer)/10% (second polymer), equal amounts of both and so on, as a design choice.

In embodiments, a toner may comprise two or more amorphous polyester resins. In embodiments, a toner can comprise a crystalline polyester resin. In embodiments, a toner comprises two or more amorphous resins and a crystalline resin.

In embodiments where a toner comprises, for example, two amorphous resins and a crystalline resin, the weight ratio of the three resins may be from about 20% of a first amorphous resin/70% of a second amorphous resin/10% of a crystalline resin, to about 60% of a first amorphous resin/20% of a second amorphous resin/20% of a crystalline resin.

In embodiments, when two amorphous polyester resins are utilized, one of the amorphous polyester resins may be of high molecular weight and the second amorphous polyester resin may be of low molecular weight. As used herein, a high molecular weight amorphous resin may have, for example, a weight average molecular weight ($M_w$) greater than about 55,000, for example, from about 55,000 to about 150,000, in embodiments, from about 50,000 to about 100,000, in embodiments, from about 60,000 to about 95,000, in embodiments, from about 70,000 to about 85,000, as determined by gel permeation chromatography (GPC), using polystyrene standards.

A high molecular weight amorphous polyester resin may have an acid value of from about 8 to about 20 mg KOH/grams, in embodiments, from about 9 to about 16 mg KOH/grams, in embodiments, from about 11 to about 15 mg KOH/grams. The high molecular weight amorphous polyester resin, which are available from a number of commercial sources, can possess various melting points of, for example, from about 30° C. to about 140° C., in embodiments, from about 75° C. to about 130° C., in embodiments, from about 100° C. to about 125° C., in embodiments, from about 115° C. to about 121° C.

A low molecular weight amorphous polyester resin has, for example, an $M_w$ of 50,000 or less, for example, from about 2,000 to about 50,000, in embodiments, from about 3,000 to about 40,000, in embodiments, from about 10,000 to about 30,000, in embodiments, from about 15,000 to about 25,000, as determined by GPC using polystyrene standards. The low molecular weight amorphous polyester resins, available from commercial sources, may have an acid value of from about 8 to about 20 mg KOH/grams, in embodiments, from about 9 to about 16 mg KOH/grams, in embodiments, from about 10 to about 14 mg KOH/grams. The low molecular weight amorphous resins can possess an onset $T_g$ of, for example, from about 40° C. to about 80° C., in embodiments, from about 50°

C. to about 70° C., in embodiments, from about 58° C. to about 62° C., as measured by, for example, differential scanning calorimetry (DSC).

The polymer(s) may be present in an amount of from about 65 to about 95% by weight, from about 75 to about 85% by weight of toner particles on a solids basis.

a. Polyester Resins

Suitable polyester resins include, for example, those which are sulfonated, non-sulfonated, crystalline, amorphous, combinations thereof and the like. The polyester resins may be linear, branched, crosslinked, combinations thereof and the like. Polyester resins may include those described, for example, in U.S. Pat. Nos. 6,593,049; 6,830,860; 7,754,406; 7,781,138; 7,749,672; and 6,756,176, the disclosure of each of which hereby is incorporated by reference in entirety.

When a mixture is used, such as, amorphous and crystalline polyester resins, the ratio of crystalline polyester resin to amorphous polyester resin can be in the range from about 1:99 to about 30:70; from about 5:95 to about 25:75; in embodiments, from about 5:95 to about 15:95.

A polyester resin may be obtained synthetically, for example, in an esterification reaction involving a reagent comprising a carboxylic acid group and another reagent comprising an alcohol. In embodiments, the alcohol reagent comprises two or more hydroxyl groups, in embodiments, three or more hydroxyl groups. In embodiments, the acid comprises two or more carboxylic acid groups, in embodiments, three or more carboxylic acid groups. Reagents comprising three or more functional groups enable, promote or enable and promote polymer branching and crosslinking. In embodiments, a polymer backbone or a polymer branch comprises at least one monomer unit comprising at least one pendant group or side group, that is, the monomer reactant from which the unit was obtained comprises at least three functional groups.

Examples of polyacids or polyesters that can be used for preparing an amorphous polyester resin include terephthalic acid, phthalic acid, isophthalic acid, fumaric acid, trimellitic acid, diethyl fumarate, dimethyl itaconate, cis-1,4-diacetoxy-2-butene, dimethyl fumarate, diethyl maleate, maleic acid, succinic acid, itaconic acid, succinic acid, cyclohexanoic acid, succinic anhydride, dodecylsuccinic acid, dodecylsuccinic anhydride, glutaric acid, glutaric anhydride, adipic acid, pimelic acid, suberic acid, azelaic acid, dodecanedioic acid, dimethyl naphthalenedicarboxylate, dimethyl terephthalate, diethyl terephthalate, dimethylisophthalate, diethylisophthalate, dimethylphthalate, phthalic anhydride, diethylphthalate, dimethylsuccinate, naphthalene dicarboxylic acid, dimer diacid, dimethylfumarate, dimethylmaleate, dimethylglutarate, dimethyladipate, dimethyl dodecylsuccinate, and combinations thereof. The organic polyacid or polyester reagent may be present, for example, in an amount from about 40 to about 60 mole % of the resin, in embodiments from about 42 to about 52 mole % of the resin, in embodiments from about 45 to about 50 mole % of the resin, and optionally a second polyacid can be used in an amount from about 0.1 to about 10 mole % of the resin, from about 0.2 to about 8 mole % of the resin, from about 0.3 to about 6 mole % of the resin.

Examples of polyols which may be used in generating an amorphous polyester resin include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl) oxide, dipropylene glycol, dibutylene glycol, and combinations thereof. The amount of organic polyol can vary, and may be present, for example, in an amount from about 40 to about 60 mole % of the resin, in embodiments from about 42 to about 55 mole % of the resin, in embodiments from about 45 to about 53 mole % of the resin, and a second polyol can be used in an amount from about 0.1 to about 10 mole %, in embodiments, from about 0.5 to about 8 mole %, from about 1 to about 4 mole % of the resin.

Polycondensation catalysts may be used in forming the amorphous (or crystalline) polyester resin, and include tetraalkyl titanates, dialkyltin oxides, such as, dibutyltin oxide, tetraalkyltins, such as, dibutyltin dilaurate, and dialkyltin oxide hydroxides, such as, butyltin oxide hydroxide, aluminum alkoxides, alkyl zinc, dialkyl zinc, zinc oxide, stannous oxide, or combinations thereof. Such catalysts may be used in amounts of, for example, from about 0.01 mole % to about 5 mole % based on the starting polyacid or polyester reagent(s) used to generate the polyester resin.

In embodiments, the resin may be a crosslinked or a crosslinkable resin. A crosslinkable resin is a resin including a crosslinkable group or groups such as a C═C bond or a pendant group or side group, such as, a carboxylic acid group. The resin can be crosslinked, for example, through a free radical polymerization with an initiator.

Examples of amorphous resins which may be used include alkali sulfonated-polyester resins, branched alkali sulfonated-polyester resins, alkali sulfonated-polyimide resins and branched alkali sulfonated-polyimide resins. Alkali sulfonated polyester resins may be useful in embodiments, such as, the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly(propylene-butylene-terephthalate)-copoly(propylene-butylene-5-sulfo-isophthalate), copoly(propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), wherein the alkali metal is, for example, a sodium, a lithium or a potassium ion.

In embodiments, an unsaturated amorphous polyester resin may be used as a latex resin. Examples of such resins include those disclosed in U.S. Pat. No. 6,063,827, the disclosure of which hereby is incorporated by reference in entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate) and combinations thereof.

In embodiments, a suitable amorphous resin may include alkoxylated bisphenol A fumarate/terephthalate-based polyester and copolyester resins. In embodiments, a suitable polyester resin may be an amorphous polyester resin, such as, a poly(propoxylated bisphenol A co-fumarate) resin. Examples of such resins and processes for production thereof include those disclosed in U.S. Pat. No. 6,063,827.

An example of a linear propoxylated bisphenol A fumarate resin is available under the trade name SPARII from Resana S/A Industrias Quimicas, Sao Paulo Brazil. Other propoxylated bisphenol A fumarate resins that are commercially available include GTUF and FPESL-2 from Kao Corporation, Japan, and EM181635 from Reichhold, Research Triangle Park, N.C., and the like.

For forming a crystalline polyester resin, suitable organic polyols include aliphatic polyols with from about 2 to about 36 carbon atoms, such as 1,2-ethanediol, 1,3-propanediol, 1,4-butanediol, 1,5-pentanediol, 2,2-dimethylpropane-1,3-diol, 1,6-hexanediol, 1,7-heptanediol, 1,8-octanediol, 1,9-nonanediol, 1,10-decanediol, 1,12-dodecanediol and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like, including their structural isomers. The aliphatic polyol may be, for example, selected in an amount from about 40 to about 60 mole %, in embodiments from about 42 to about 55 mole %, in embodiments from about 45 to about 53 mole %, and a second polyol can be used in an amount from about 0.1 to about 10 mole %, in embodiments, from about 0.3 to about 8 mole %, from about 1 to about 4 mole % of the resin.

Examples of organic polyacid or polyester reagents for preparing a crystalline resin include oxalic acid, succinic acid, glutaric acid, adipic acid, suberic acid, azelaic acid, sebacic acid, fumaric acid, dimethyl fumarate, dimethyl itaconate, cis, 1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid (sometimes referred to herein, in embodiments, as cyclohexanedioic acid), malonic acid and mesaconic acid, a polyester or anhydride thereof; and an alkali sulfo-organic polyacid, such as, the sodio, lithio or potassio salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfo-p-hydroxybenzoic acid, N,N-bis(2-hydroxyethyl)-2-amino ethane sulfonate, or mixtures thereof. The organic polyacid may be selected in an amount of, for example, in embodiments from about 40 to about 60 mole %, in embodiments from about 42 to about 52 mole %, in embodiments from about 45 to about 50 mole %, and optionally, a second polyacid can be selected in an amount from about 0.1 to about 10 mole % of the resin, from about 0.3 to about 7 mole % of the resin, from about 0.5 to about 5 mole % of the resin.

Specific crystalline resins include poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), copoly(2,2-dimethylpropane-1,3-diol-decanoate)-copoly(ethylene-adipate), alkali copoly(5-sulfoisophthaloyl)-copoly(propylene-adipate), alkali copoly(5-sulfoisophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfoisophthaloyl)-copoly(ethylene-succinate), alkali copoly(5-sulfoisophthaloyl)-copoly(propylene-succinate), alkali copoly(5-sulfoisophthaloyl)-copoly(butylenes-succinate), alkali copoly(5-sulfoisophthaloyl)-copoly(pentylene-succinate), alkali copoly(5-sulfoisophthaloyl)-copoly(hexylene-succinate), alkali copoly(5-sulfoisophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipatenonylene-decanoate), poly(octylene-adipate), and so on, wherein alkali is a metal like sodium, lithium or potassium. Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinimide), and poly(propylene-sebecamide). Examples of polyimides include poly(ethylene-adipimide), poly(propylene-adipimide), poly(butylene-adipimide), poly(pentylene-adipimide), poly(hexylene-adipimide), poly(octylene-adipimide), poly(ethylene-succinimide), poly(propylene-succinimide), and poly(butylene-succinimide).

Suitable crystalline resins which may be utilized, optionally in combination with an amorphous resin as described above, include those disclosed in U.S. Pub. No. 2006/0222991, the disclosure of which is hereby incorporated by reference in entirety.

In embodiments, a suitable crystalline resin may include a resin formed of ethylene glycol and a mixture of dodecanedioic acid and fumaric acid co-monomers. The crystalline resin may be present, for example, in an amount from about 1 to about 85% by weight of the toner components, in embodiments from about 2 to about 50% by weight of the toner components, in embodiments from about 5 to about 15% by weight of the toner components. The crystalline resin can possess various melting points of, for example, from about 30° C. to about 120° C., in embodiments, from about 50° C. to about 90° C., in embodiments, from about 60° C. to about 80° C.

The crystalline resin may have a number average molecular weight ($M_n$), of, for example, from about 1,000 to about 50,000, in embodiments from about 2,000 to about 25,000, and an $M_w$ of, for example, from about 2,000 to about 100,000, in embodiments from about 3,000 to about 80,000. The molecular weight distribution ($M_w/M_n$ or PD) of the crystalline resin may be, for example, from about 2 to about 6, in embodiments, from about 3 to about 4.

Examples of other suitable resins or polymers which may be utilized in forming a toner include, but are not limited to, poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), and combinations thereof. The polymer may be, for example, block, random, or alternating copolymers.

b. Catalyst

Condensation catalysts which may be used in the polyester reaction include tetraalkyl titanates; dialkyltin oxides, such as, dibutyltin oxide; tetraalkyltins, such as, dibutyltin dilaurate; dibutyltin diacetate; dibutyltin oxide; dialkyltin oxide hydroxides, such as, butyltin oxide hydroxide; aluminum alkoxides, alkyl zinc, dialkyl zinc, zinc oxide, stannous oxide, stannous chloride, butylstannoic acid, or combinations thereof.

Such catalysts may be used in amounts of, for example, from about 0.01 mole % to about 5 mole % based on the amount of starting polyacid, polyol or polyester reagent in the reaction mixture.

Generally, as known in the art, the polyacid/polyester and polyols reagents are mixed together, optionally with a catalyst, and incubated at an elevated temperature, such as, from about 180° C. or more, from about 190° C. or more, from about 200° C. or more and so on, which can be conducted anaerobically, to enable esterification to occur until equilibrium, which generally yields water or an alcohol, such as, methanol, arising from forming the ester bonds in esterification reactions. The reaction can be conducted under vacuum to promote polymerization. The product is collected by practicing known methods, and can be dried, again, by practicing known methods to yield particulates.

Branching agents can be used, and include, for example, a multivalent polyacid such as 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl) methane, 1,2,7,8-octanetetracarboxylic acid, acid anhydrides thereof, lower alkyl esters thereof and so on. The branching agent can be used in an amount from about 0.01 to about 10 mole % of the resin, from about 0.05 to about 8 mole %, from about 0.1 to about 5 mole % of the resin.

It may be desirable to crosslink the polymer. A suitable resin conducive to crosslinking is one with a reactive group, such as, a C═C bond or with pendant or side groups, such as, a carboxylic acid group. The resin can be crosslinked, for example, through free radical polymerization with an initiator. Suitable initiators include peroxides such as, organic peroxides or azo compounds, for example diacyl peroxides, such as, decanoyl peroxide, lauroyl peroxide and benzoyl peroxide, ketone peroxides, such as, cyclohexanone peroxide and methyl ethyl ketone, alkyl peroxy esters, such as, t-butyl peroxy neodecanoate, 2,5-dimethyl 2,5-di(2-ethyl hexanoyl peroxy)hexane, tamyl peroxy 2-ethyl hexanoate, t-butyl peroxy 2-ethyl hexanoate, t-butyl peroxy acetate, t-amyl peroxy acetate, t-butyl peroxy benzoate, t-amyl peroxy benzoate, alkyl peroxides, such as, dicumyl peroxide, 2,5-dimethyl 2,5-di(t-butyl peroxy)hexane, t-butyl cumyl peroxide, bis(t-butyl peroxy)diisopropyl benzene, di-t-butyl peroxide and 2,5-dimethyl 2,5-di(t-butyl peroxy)hexyne-3, alkyl hydroperoxides, such as, 2,5-dihydro peroxy 2,5-dimethyl hexane, cumene hydroperoxide, t-butyl hydroperoxide and t-amyl hydroperoxide, and alkyl peroxyketals, such as, n-butyl 4,4-di(t-butyl peroxy)valerate, 1,1-di(t-butyl peroxy) 3,3,5-trimethyl cyclohexane, 1,1-di(t-butyl peroxy)cyclohexane, 1,1-di(t-amyl peroxy)cyclohexane, 2,2-di(t-butyl peroxy)butane, ethyl 3,3-di(t-butyl peroxy)butyrate and ethyl 3,3-di(t-amyl peroxy)butyrate, azobis-isobutyronitrile, 2,2'-azobis(isobutyronitrile), 2,2'-azobis(2,4-dimethyl valeronitrile), 2,2'-azobis(methyl butyronitrile), 1,1'-azobis(cyano cyclohexane), 1,1-di(t-butylperoxy)-3,3,5-trimethylcyclohexane, combinations thereof and the like. The amount of initiator used is proportional to the degree of crosslinking, and thus, the gel content of the polyester material. The amount of initiator used may range from, for example, about 0.01 to about 10 weight %, from about 0.1 to about 5 weight % of the polyester resin. In the crosslinking, it is desirable that substantially all of the initiator be consumed. The crosslinking may be carried out at high temperature, and thus the reaction may be very fast, for example, less than 10 minutes, such as from about 20 seconds to about 2 minutes residence time.

The polymer reagent then can be incorporated with, for example, other reagents suitable for making a toner particle, such as, a colorant and/or a wax, and processed in a known manner to produce toner particles.

2. Colorants

Suitable colorants include those comprising carbon black, such as, REGAL 330® and Nipex 35; magnetites, such as, Mobay magnetites, MO8029™ and MO8060™; Columbian magnetites, MAPICO® BLACK; surface-treated magnetites; Pfizer magnetites, CB4799™, CB5300™, CB5600™ and MCX6369™; Bayer magnetites, BAYFERROX 8600™ and 8610™; Northern Pigments magnetites, NP604™ and NP-608™; Magnox magnetites, TMB-100™ or TMB104™; and the like.

Colored pigments, such as, cyan, magenta, yellow, red, orange, green, brown, blue or mixtures thereof can be used. The additional pigment or pigments can be used as water-based pigment dispersions. Some colorants are conductive, that is, carry, conduct, transmit an electric charge, such as, some black colorants.

Examples of pigments include SUNSPERSE 6000, FLEXIVERSE and AQUATONE, water-based pigment dispersions from SUN Chemicals; HELIOGEN BLUE L6900™, D6840™, D7080™, D7020™, PYLAM OIL BLUE™, PYLAM OIL YELLOW™ and PIGMENT BLUE I™ available from Paul Uhlich & Company, Inc.; PIGMENT VIOLET I™, PIGMENT RED 48™, LEMON CHROME YELLOW DCC 1026™, TOLUIDINE RED™ and BON RED C™ available from Dominion Color Corporation, Ltd., Toronto, Ontario; NOVAPERM YELLOW FGL™ and HOS- TAPERM PINK E™ from Hoechst; CINQUASIA MAGENTA™ available from E.I. DuPont de Nemours & Co., and the like.

Examples of magenta pigments include 2,9-dimethyl-substituted quinacridone, an anthraquinone dye identified in the Color Index as CI 60710, CI Dispersed Red 15, a diazo dye identified in the Color Index as CI 26050, CI Solvent Red 19, and the like.

Illustrative examples of cyan pigments include copper tetra (octadecylsulfonamido)phthalocyanine, a copper phthalocyanine pigment listed in the Color Index as CI 74160, CI Pigment Blue, Pigment Blue 15:3, Pigment Blue 15:4, an Anthrazine Blue identified in the Color Index as CI 69810, Special Blue X-2137, and the like.

Illustrative examples of yellow pigments are diarylide yellow 3,3dichlorobenzidene acetoacetanilide, a monoazo pigment identified in the Color Index as CI 12700, CI Solvent Yellow 16, a nitrophenyl amine sulfonamide identified in the Color Index as Foron Yellow SE/GLN, CI Disperse Yellow 3, 2,5dimethoxy-4-sulfonanilide phenylazo-4'-chloro-2,5-dimethoxy acetoacetanilide and Permanent Yellow FGL.

Other known colorants can be used, such as, Levanyl Black ASF (Miles, Bayer) and Sunsperse Carbon Black LHD 9303 (Sun Chemicals), and colored dyes, such as, Neopen Blue (BASF), Sudan Blue OS (BASF), PV Fast Blue B2G 01 (American Hoechst), Sunsperse Blue BHD 6000 (Sun Chemicals), Irgalite Blue BCA (CibaGeigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), SUCD-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing and the like. Other pigments that can be used, and which are commercially available include various pigments in the color classes, Pigment Yellow 74, Pigment Yellow 14, Pigment Yellow 83, Pigment Orange 34, Pigment Red 238, Pigment Red 122, Pigment Red 48:1, Pigment Red 269, Pigment Red 53:1, Pigment Red 57:1, Pigment Red 83:1, Pigment Violet 23, Pigment Green 7 and so on, and combinations thereof.

The colorant, for example furnace carbon black, cyan, magenta and/or yellow colorant, may be incorporated in an amount sufficient to impart the desired color to the toner. In general, pigment or dye, may be employed in an amount ranging from about 2% to about 50% by weight of the toner particles on a solids basis, from about 5% to about 40% by weight, from about 7% to about 30% by weight.

In embodiments, more than one colorant may be present in a toner particle. For example, two colorants may be present in a toner particle, such as, a first colorant of pigment blue, may be present in an amount ranging from about 2% to about 10% by weight of the toner particle on a solids basis, from about 3% to about 8% by weight, from about 5% to about 10% by weight; with a second colorant of pigment yellow that may be present in an amount ranging from about 5% to about 20% by weight of the toner particle on a solids basis, from about 6% to about 15% by weight, from about 10% to about 20% by weight and so on.

3. Optional Components a. Surfactants

In embodiments, toner compositions may be in dispersions including surfactants. Emulsion aggregation methods where the polymer and other components of the toner are in combination can employ one or more surfactants to form an emulsion.

One, two or more surfactants may be used. The surfactants may be selected from ionic surfactants and nonionic surfactants, or combinations thereof. Anionic surfactants and cationic surfactants are encompassed by the term, "ionic surfactants."

In embodiments, the surfactant or the total amount of surfactants may be used in an amount of from about 0.01% to about 5% by weight of the toner forming composition, for example, from about 0.75% to about 4% by weight of the toner-forming composition, in embodiments, from about 1% to about 3% by weight of the toner-forming composition.

Examples of nonionic surfactants include, for example, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether and dialkylphenoxy poly(ethyleneoxy)ethanol, for example, available from Rhone-Poulenc as IGEPAL CA-210™, IGEPAL CA520™, IGEPAL CA-720™, IGEPAL CO-890™, IGEPAL CO-720™, IGEPAL CO-290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC® PR/F, in embodiments, SYNPERONIC® PR/F 108; and a DOWFAX, available from The Dow Chemical Corp.

Anionic surfactants include sulfates and sulfonates, such as, sodium dodecylsulfate (SDS), sodium dodecylbenzene sulfonate, sodium dodecylnaphthalene sulfate and so on; dialkyl benzenealkyl sulfates; acids, such as, palmitic acid, and NEOGEN or NEOGEN SC obtained from Daiichi Kogyo Seiyaku, and so on, combinations thereof and the like. Other suitable anionic surfactants include, in embodiments, alkyldiphenyloxide disulfonates or TAYCA POWER BN2060 from Tayca Corporation (Japan), which is a branched sodium dodecyl benzene sulfonate. Combinations of those surfactants and any of the foregoing nonionic surfactants may be used in embodiments.

Examples of cationic surfactants include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, trimethyl ammonium bromides, halide salts of quarternized polyoxyethylalkylamines, dodecylbenzyl triethyl ammonium chlorides, MIRAPOL® and ALKAQUAT® available from Alkaril Chemical Company, SANISOL® (benzalkonium chloride) available from Kao Chemicals and the like, and mixtures thereof, including, for example, a nonionic surfactant as known in the art or provided hereinabove.

b. Waxes

The toners of the instant disclosure can contain a wax, which can be either a single type of wax or a mixture of two or more different types of waxes (hereinafter identified as, "a wax"). A wax can be added to a toner formulation or to a developer formulation, for example, to improve particular toner properties, such as, toner particle shape, charging, fusing characteristics, gloss, stripping, offset properties and the like. Alternatively, a combination of waxes can be added to provide multiple properties to a toner or a developer composition. A wax may be included as, for example, a fuser roll release agent.

The wax may be combined with the resin-forming composition for forming toner particles. When included, the wax may be present in an amount of, for example, from about 1 wt % to about 25 wt % of the toner particles, in embodiments, from about 5 wt % to about 20 wt % of the toner particles.

Waxes that may be selected include waxes having, for example, a weight average molecular weight of from about 500 to about 20,000, in embodiments, from about 1,000 to about 10,000. Waxes that may be used include, for example, polyolefins, such as, polyethylene, polypropylene and polybutene waxes, such as, those that are commercially available, for example, POLYWAX™ polyethylene waxes from Baker Petrolite, wax emulsions available from Michaelman, Inc. or Daniels Products Co., EPOLENE N15™ which is commercially available from Eastman Chemical Products, Inc., VISCOL 550P™, a low weight average molecular weight polypropylene available from Sanyo Kasei K.K.; plant-based waxes, such as carnauba wax, rice wax, candelilla wax, sumac wax and jojoba oil; animal-based waxes, such as beeswax; mineral-based waxes and petroleum-based waxes, such as montan wax, ozokerite, ceresin wax, paraffin wax, microcrystalline wax and FischerTropsch waxes; ester waxes obtained from higher fatty acids and higher alcohols, such as stearyl stearate and behenyl behenate; ester waxes obtained from higher fatty acids and monovalent or multivalent lower alcohols, such as butyl stearate, propyl oleate, glyceride monostearate, glyceride distearate and pentaerythritol tetrabehenate; ester waxes obtained from higher fatty acids and multivalent alcohol multimers, such as diethyleneglycol monostearate, dipropyleneglycol distearate, diglyceryl distearate and triglyceryl tetrastearate; sorbitan higher fatty acid ester waxes, such as sorbitan monostearate; cholesterol higher fatty acid ester waxes, such as, cholesteryl stearate, and so on.

Examples of functionalized waxes that may be used include, for example, amines and amides, for example, AQUA SUPERSLIP 6550™ and SUPERSLIP 6530™ available from Micro Powder Inc.; fluorinated waxes, for example, POLYFLUO 190™, POLYFLUO 200™, POLYSILK 19™ and POLYSILK 14™ available from Micro Powder Inc.; mixed fluorinated amide waxes, for example, MICROSPERSION 19™ also available from Micro Powder Inc.; imides, esters, quaternary amines, carboxylic acids, acrylic polymer emulsions, for example, JONCRYL 74™, 89™, 130™, 537™ and 538™ available from SC Johnson Wax; and chlorinated polypropylenes and polyethylenes available from Allied Chemical, Petrolite Corp. and SC Johnson. Mixtures and combinations of the foregoing waxes also may be used in embodiments.

The wax or waxes used can be of any melting temperature. When plural waxes are used, the melting temperatures thereof can be similar. The melting temperatures are used to determine the coalescence temperature as taught hereinbelow.

c. Aggregating Factor

An aggregating factor may be an inorganic cationic coagulant, such as, for example, polyaluminum chloride (PAC), polyaluminum sulfosilicate (PASS), aluminum sulfate, zinc sulfate, magnesium sulfate, chlorides of magnesium or calcium, zinc, beryllium, aluminum, sodium, other metal halides including monovalent and divalent halides, and so on.

The aggregating factor may be present in an emulsion in an amount of from, for example, from about 0 to about 10 wt %, from about 0.05 to about 5 wt % based on the total solids in the toner.

The aggregating factor may also contain minor amounts of other components, for example, nitric acid.

In embodiments, a sequestering agent or chelating agent may be introduced after aggregation is complete to sequester or extract a metal complexing ion, such as, aluminum from the aggregation process. Thus, the sequestering, chelating or complexing agent used after aggregation is complete may comprise an organic complexing component, such as, ethylenediaminetetraacetic acid (EDTA), gluconal, hydroxyl-2, 2'iminodisuccinic acid (HIDS), dicarboxylmethyl glutamic acid (GLDA), methyl glycidyl diacetic acid (MGDA), hydroxydiethyliminodiacetic acid (HIDA), sodium gluconate, potassium citrate, sodium citrate, nitrotriacetate salt, humic acid, fulvic acid; salts of EDTA, such as, alkali metal salts of EDTA, tartaric acid, gluconic acid, oxalic acid, polyacrylates, sugar acrylates, citric acid, polyasparic acid, diethylenetriamine pentaacetate, 3-hydroxy-4-pyridinone, dopamine, eucalyptus, iminodisuccinic acid, ethylenediaminedisuccinate, polysaccharide, sodium ethylenedinitrilotetraacetate, thiamine pyrophosphate, farnesyl pyrophosphate, 2-aminoethylpyrophosphate, hydroxyl ethylidene-1, 1-diphosphonic acid, aminotrimethylenephosphonic acid, diethylene triaminepentamethylene phosphonic acid, ethylenediamine tetramethylene phosphonic acid, and mixtures thereof.

d. Surface Additive

In embodiments, the toner particles can be mixed with one or more of, for example, silicon dioxide or silica ($SiO_2$), titania or titanium dioxide ($TiO_2$) and/or cerium oxide. Silica may be a first silica and a second silica. The first silica may have an average primary particle size, measured in diameter, in the range of, for example, from about 5 nm to about 50 nm, such as, from about 5 nm to about 25 nm or from about 20 nm to about 40 nm. The second silica may have an average primary particle size, measured in diameter, in the range of, for example, from about 100 nm to about 200 nm, such as, from about 100 nm to about 150 nm or from about 125 nm to about 145 nm. The second silica may have a larger average size (diameter) than the first silica. The titania may have an average primary particle size in the range of, for example, about 5 nm to about 50 nm, such as, from about 5 nm to about 20 nm or from about 10 nm to about 50 nm. The cerium oxide may have an average primary particle size in the range of, for example, about 5 nm to about 50 nm, such as, from about 5 nm to about 20 nm or from about 10 nm to about 50 nm.

Zinc stearate also may be used as an external additive. Calcium stearate and magnesium stearate may provide similar functions. Zinc stearate may have an average primary particle size in the range of, for example, from about 500 nm to about 700 nm, such as, from about 500 nm to about 600 nm or from about 550 nm to about 650 nm.

e. Carrier

Carrier particles include those that are capable of triboelectrically obtaining a charge of polarity opposite to that of the toner particles. Illustrative examples of suitable carrier particles include granular zircon, granular silicon, glass, steel, nickel, ferrites, iron ferrites, silicon dioxide, nickel berry carriers as disclosed in U.S. Pat. No. 3,847,604, the entire disclosure of which is hereby incorporated herein by reference, comprised of nodular carrier beads of nickel, characterized by surfaces of reoccurring recesses and protrusions thereby providing particles with a relatively large external area, those disclosed in U.S. Pat. Nos. 4,937,166 and 4,935,326, the disclosure of each of which hereby is incorporated herein by reference, and so on. In embodiments, the carrier particles may have an average particle size of, for example, from about 20 to about 85 μm, such as, from about 30 to about 60 μm, or from about 35 to about 50 μm.

A toner of interest comprises, among other reagents, a crystalline resin, a wax or both.

B. Toner Particle Preparation

1. Method a. Particle Formation

The toner particles may be prepared by any method within the purview of one skilled in the art, for example, any of the emulsion/aggregation methods can be used with a polyester resin and the thermal carbon black of interest. However, any suitable method of preparing toner particles may be used, including chemical processes, such as, suspension and encapsulation processes disclosed, for example, in U.S. Pat. Nos. 5,290,654 and 5,302,486, the disclosure of each of which hereby is incorporated by reference in entirety; by conventional granulation methods, such as, jet milling; pelletizing slabs of material; other mechanical processes; any process for producing nanoparticles or microparticles; and so on.

In embodiments relating to an emulsification/aggregation process, a resin can be dissolved in a solvent, and can be mixed into an emulsion medium, for example water, such as, deionized water, optionally containing a stabilizer, and optionally a surfactant. Examples of suitable stabilizers include water-soluble alkali metal hydroxides, such as, sodium hydroxide, potassium hydroxide, lithium hydroxide, beryllium hydroxide, magnesium hydroxide, calcium hydroxide or barium hydroxide; ammonium hydroxide; alkali metal carbonates, such as, sodium bicarbonate, lithium bicarbonate, potassium bicarbonate, lithium carbonate, potassium carbonate, sodium carbonate, beryllium carbonate, magnesium carbonate, calcium carbonate, barium carbonate or cesium carbonate; or mixtures thereof. When a stabilizer is used, the stabilizer can be present in amounts of from about 0.1% to about 5%, from about 0.5% to about 3% by weight of the resin. When such salts are added to the composition as a stabilizer, in embodiments, incompatible metal salts are not present in the composition, for example, a composition can be completely or essentially free of zinc and other incompatible metal ions, for example, Ca, Fe, Ba etc., that form water-insoluble salts. The term, "essentially free," refers, for example, to the incompatible metal ions as present at a level of less than about 0.01%, less than about 0.005%, less than about 0.001%, by weight of the wax and resin. The stabilizer can be added to the mixture at ambient temperature, or can be heated to the mixture temperature prior to addition.

Optionally, a surfactant may be added to the aqueous emulsion medium, for example, to afford additional stabilization to the resin or to enhance emulsification of the resin. Suitable surfactants include anionic, cationic and nonionic surfactants as taught herein.

Following emulsification, toner compositions may be prepared by aggregating a mixture of a resin, a pigment, an optional wax and any other desired additives in an emulsion, optionally, with surfactants as described above, and then optionally coalescing the aggregate mixture. A mixture may be prepared by adding an optional wax or other materials, which may also be optionally in a dispersion, including a surfactant, to the emulsion comprising a resin-forming material and a pigments, which may be a mixture of two or more emulsions containing the requisite reagents. The pH of the resulting mixture may be adjusted with an acid, such as, for example, acetic acid, nitric acid or the like. In embodiments, the pH of the mixture may be adjusted to from about 2 to about 4.5.

Additionally, in embodiments, the mixture may be homogenized. If the mixture is homogenized, mixing can be at from about 600 to about 4,000 rpm. Homogenization may be by any suitable means, including, for example, an IKA ULTRA TURRAX T50 probe homogenizer.

b. Aggregation

Following preparation of the above mixture, often, it is desirable to form larger particles or aggregates, often sized in micrometers, of the smaller particles from the initial polymerization reaction, often sized in nanometers. An aggregating factor may be added to the mixture. Suitable aggregating factors include, for example, aqueous solutions of a divalent cation, a multivalent cation or a compound comprising same.

The aggregating factor, as provided above, may be, for example, a polyaluminum halide, such as, polyaluminum chloride (PAC) or the corresponding bromide, fluoride or iodide; a polyaluminum silicate, such as, polyaluminum sulfosilicate (PASS); or a water soluble metal salt, including, aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate or combinations thereof.

In embodiments, the aggregating factor may be added to the mixture at a temperature that is below the melting point of a crystalline resin, a wax or both, when present, whichever is lower.

The aggregating factor may be added to the mixture components to form a toner in an amount of, for example, from about 0.1 part per hundred (pph) to about 1 pph, in embodiments, from about 0.25 pph to about 0.75 pph, in embodiments.

To control aggregation of the particles, the aggregating factor may be metered into the mixture over time. For example, the factor may be added incrementally into the mixture over a period of from about 5 to about 240 minutes, in embodiments, from about 30 to about 200 minutes.

Addition of the aggregating factor also may be done while the mixture is maintained under stirred conditions, in embodiments, from about 50 rpm to about 1,000 rpm, in embodiments, from about 100 rpm to about 500 rpm; and at a temperature that is below the melting point of a crystalline resin or below the melting point of a wax, whichever temperature is lower, for example, in embodiments, from about 30° C. to about 60° C., in embodiments, from about 35° C. to about 60° C. The growth and shaping of the particles following addition of the aggregation factor may be accomplished under any other suitable condition(s).

The particles may be permitted to aggregate until a predetermined desired particle size is obtained. Particle size can be monitored during the growth process. For example, samples may be taken during the growth process and analyzed, for example, with a Coulter Counter, for average particle size. The aggregation thus may proceed by maintaining the mixture, for example, at elevated temperature, or slowly raising the temperature, for example, from about 45° C. to about 60° C., and holding the mixture at that temperature for from about 0.5 hours to about 6 hours, in embodiments, from about hour 1 to about 5 hours, while maintaining stirring, to provide the desired aggregated particles. Once the predetermined desired particle size is attained, the growth process is halted.

The characteristics of the toner particles may be determined by any suitable technique and apparatus. Volume average particle diameter and geometric standard deviation may be measured using an instrument, such as, a Beckman Coulter Multisizer 3, operated in accordance with the instructions of the manufacturer. Representative sampling may occur by taking a sample, filtering through a 25 μm membrane, diluting in an isotonic solution to obtain a concentration of about 10% and then reading the sample, for example, in a Beckman COULTER MULTISIZER 3.

The growth and shaping may be conducted under conditions in which aggregation occurs separate from coalescence. For separate aggregation and coalescence stages, the aggregation process may be conducted under shearing conditions at an elevated temperature, for example, of from about 30° C. to about 60° C., in embodiments, from about 35° C. to about 60° C., which may be below the melting point of a wax or a crystalline resin, which temperature is lower. In embodiments, coalescence may be conducted from about 60° C. to about 85° C., from about 65° C. to about 80° C.

In embodiments, the aggregated particles may be of a size of less than about 3 μm, in embodiments, from about 2 μm to about 3 μm, in embodiments, from about 2.5 μm to about 2.9 μm.

In embodiments, after aggregation, but prior to coalescence, a resin coating may be applied to the aggregated particles to form a shell thereover. Any resin described herein or as known in the art may be used as the shell. In embodiments, a polyester amorphous resin latex as described herein may be included in the shell. In embodiments, a polyester amorphous resin latex described herein may be combined with a different resin, and then added to the particles as a resin coating to form a shell.

A shell resin may be applied to the aggregated particles by any method within the purview of those skilled in the art. In embodiments, the resins used to form the shell may be in an emulsion, optionally including any surfactant described herein. The emulsion possessing the resins may be combined with the aggregated particles so that the shell forms over the aggregated particles.

The formation of the shell over the aggregated particles may occur while heating to a temperature from about 30° C. to about 80° C., in embodiments, from about 35° C. to about 75° C., so long as the temperature is below that of a crystalline resin or a wax, whenever either is present and whichever temperature is lower. The formation of the shell may take place for a period of time from about 5 minutes to about 10 hours, in embodiments, from about 10 minutes to about 5 hours.

The shell may be present in an amount from about 1% by weight to about 80% by weight of the toner components, in embodiments, from about 10% by weight to about 40% by weight of the toner components, in embodiments, from about 20% by weight to about 35% by weight of the toner components. In embodiments, the shell comprises about 20% by weight of the toner particle, about 30% by weight, about 40% by weight, about 50% by weight of the toner particle.

c. Coalescence

Following aggregation to a desired particle size and application of any optional shell, the particles are coalesced to a desired final shape, such as, a circular shape, for example, to correct for irregularities in shape and size, the coalescence being achieved by, for example, heating the mixture to a temperature from about 60° C. to about 85° C., in embodiments, from about 65° C. to about 80° C., in embodiments, from about 50° C. to about 75° C., in embodiments, from about 55° C. to about 73° C., so long as the temperature is below the melting point of any crystalline resin or any wax used to form the toner particles, which temperature is lower or the lowest. In embodiments, the temperature can be less than about 80° C., less than about 77° C., less than about 75° C., in embodiments, less than about 73° C. In embodiments, the mixture may be stirred and the rate may be reduced, for example, from about 1000 rpm to about 100 rpm, in embodiments, from about 800 rpm to about 200 rpm. Coalescence may be conducted over a period from about 0.01 to about 9 hours, in embodiments, from about 0.1 to about 4 hours, see, for example, U.S. Pat. No. 7,736,831.

After aggregation and/or coalescence, the mixture may be quench cooled to a reduced temperature as compared to that used in aggregation coalescence, when practiced. In embodiments, the quench temperature is below the $T_g$ of the resin, such as, from about 50° C. to about 40° C., in embodiments, to room temperature, such as, from about 20° C. to about 25° C., in embodiments, to a temperature below room temperature, for example, from about 10° C. to about 0° C. A suitable cooling method may include introducing cold water to a jacket around the reactor or using a heat exchanger. By, "quench cooling," is meant a rapid cooling of the reaction mixture from the coalescing temperature to the desired lower temperature, in embodiments, lower than the $T_g$ of the resin (s), the melting temperature of the wax or both, whatever the means, at a rate of about 1° C./min, about 2° C./min, about 3° C./min or faster. Hence, as known, in the art, a heat exchanger can be used, the particles can be suspended in a medium at reduced temperature and so on. For the purposes herein, any temperature reduction rate during cooling of less than about 1° C./min is considered a slow cooling, not a quench or rapid cooling, such as, less than about 0.9° C./min, less than about 0.8° C./min. less than about 0.7° C./min reduction in temperature.

After cooling, the toner particles optionally may be washed with water and then dried. Drying may be by any suitable method, including, for example, freeze-drying. In embodiments, the toner particles may be washed at room temperature using multiple deionized (DI) water washings and dried using an ALJET THERMAJET DRYER Model 4.

Optionally, a coalescing agent can be used. Examples of suitable coalescence agents include, but are not limited to, benzoic acid alkyl esters, ester alcohols, glycol/ether-type solvents, long chain aliphatic alcohols, aromatic alcohols, mixtures thereof and the like. Examples of benzoic acid alkyl esters include those where the alkyl group, which can be straight or branched, substituted or unsubstituted, has from about 2 to about 30 carbon atoms, such as, decyl or isodecyl benzoate, nonyl or isononyl benzoate, octyl or isooctyl benzoate, 2-ethylhexyl benzoate, tridecyl or isotridecyl benzoate, 3,7dimethyloctyl benzoate, 3,5,5-trimethylhexyl benzoate, mixtures thereof and the like. Examples of such benzoic acid alkyl esters include VELTA® 262 (isodecyl benzoate) and VELTA® 368 (2-ethylhexyl benzoate) available from Velsicol Chemical Corp. Examples of ester alcohols include hydroxyalkyl esters of alkanoic acids, where the alkyl group, which can be straight or branched, substituted or unsubstituted, and can have from about 2 to about 30 carbon atoms, such as, 2,2,4trimethylpentane-1,3-diol monoisobutyrate. An example of an ester alcohol is TEXANOL® (2,2,4-trimethylpentane-1,3-diol monoisobutyrate) available from Eastman Chemical Co. Examples of glycol/ether-type solvents include diethylene glycol monomethylether acetate, diethylene glycol monobutylether acetate, butyl carbitol acetate (BCA) and the like. Examples of long chain aliphatic alcohols include those where the alkyl group is from about 5 to about 20 carbon atoms, such as, ethylhexanol, octanol, dodecanol and the like. Examples of aromatic alcohols include benzyl alcohol and the like.

In embodiments, the coalescence agent (or coalescing agent or coalescence aid agent) evaporates during later stages of the emulsion/aggregation process, such as, during a second heating step, that is, generally above the $T_g$ of the resin or a polymer. The final toner particles are thus, free of, or essentially or substantially free of any remaining coalescence agent. To the extent that any remaining coalescence agent may be present in a final toner particle, the amount of remaining coalescence agent is such that presence thereof does not affect any properties or the performance of the toner or developer.

The coalescence agent can be added prior to the coalescence or fusing step in any desired or suitable amount. For example, the coalescence agent can be added in an amount of from about 0.01 to about 10% by weight, based on the solids content in the reaction medium, or from about 0.05, or from about 0.1%, to about 0.5 or to about 3.0% by weight, based on the solids content in the reaction medium. Of course, amounts outside those ranges can be used, as desired.

In embodiments, the coalescence agent can be added at any time between aggregation and coalescence, although in some embodiments it may be desirable to add the coalescence agent after aggregation is, "frozen," or completed, for example, by adjustment of pH, for example, by addition, for example, of base.

Coalescence may proceed and be accomplished over a period of from about 0.1 to about 9 hours, in embodiments, from about 0.5 to about 4 hours.

d. Shells

In embodiments, an optional shell may be applied to the formed toner particles, aggregates or coalesced particles. Any polymer, including those described above as suitable for the core, may be used for the shell. The shell polymer may be applied to the particles or aggregates by any method within the purview of those skilled in the art.

In embodiments, an amorphous polyester resin may be used to form a shell over the particles or aggregates to form toner particles or aggregates having a core/shell configuration. In some embodiments, a low molecular weight amorphous polyester resin may be used to form a shell over the particles or aggregates.

The shell polymer may be present in an amount of from about 20% to about 40% by weight of the toner particles or aggregates, in embodiments, from about 25% to about 35% by weight of the toner particles or aggregates. In embodiments, the shell can comprise at least about 20% by weight of the toner, at least about 25%, at least about 30%, at least about 35%.

Once the desired final size of the toner particles or aggregates is achieved, the pH of the mixture may be adjusted with base to a value of from about 6 to about 10, in embodiments, from about 6.2 to about 7. The adjustment of pH may be used to freeze, that is, to stop, toner particle growth. The base used to stop toner particle growth may be, for example, an alkali metal hydroxide, such as, for example, sodium hydroxide, potassium hydroxide, ammonium hydroxide, combinations thereof and the like. In embodiments, EDTA may be added to assist adjusting the pH to the desired value.

The base may be added in amounts from about 2 to about 25% by weight of the mixture, in embodiments, from about 4 to about 10% by weight of the mixture. Following aggregation to the desired particle size, with the formation of an optional shell as described above, the particles then may be coalesced to the desired final shape, the coalescence being achieved by, for example, heating the mixture to a temperature of from about 55° C. to about 80° C., in embodiments, from about 65° C. to about 75° C., so long as the temperature is below the melting point of any crystalline resin or any wax, when either is present.

e. Optional Additives

In embodiments, the toner particles also may contain other optional additives.

i. Charge Additives

The toner may include any known charge additives in amounts of from about 0.1 to about 10 weight %, in embodiments, of from about 0.5 to about 7 weight % of the toner. Examples of such charge additives include alkyl pyridinium halides, bisulfates, the charge control additives of U.S. Pat. Nos. 3,944,493; 4,007,293; 4,079,014; 4,394,430; and 4,560,635, the disclosure of each of which hereby is incorporated by reference in entirety, negative charge enhancing additives, such as, aluminum complexes, and the like.

Charge enhancing molecules can be used to impart either a positive or a negative charge on a toner particle. Examples include quaternary ammonium compounds, see, for example, U.S. Pat. No. 4,298,672, organic sulfate and sulfonate compounds, see for example, U.S. Pat. No. 4,338,390, cetyl pyridinium tetrafluoroborates, distearyl dimethyl ammonium methyl sulfate, aluminum salts and so on.

Such enhancing molecules can be present in an amount of from about 0.1 to about 10%, from about 1 to about 3% by weight.

ii. Surface Modifications

Surface additives can be added to the toner compositions of the present disclosure, for example, after washing or drying. Examples of such surface additives include, for example, one or more of a metal salt, a metal salt of a fatty acid, a colloidal silica, a metal oxide, such as, $TiO_2$ (for example, for improved RH stability, tribo control and improved development and transfer stability), an aluminum oxide, a cerium oxide, a strontium titanate, $SiO_2$, mixtures thereof and the like. Examples of such additives include those disclosed in U.S. Pat. Nos. 3,590,000; 3,720,617; 3,655,374; and 3,983,045, the disclosure of each of which hereby is incorporated by reference in entirety.

Surface additives may be used in an amount of from about 0.1 to about 10 wt %, from about 0.5 to about 7 wt % of the toner.

Other surface additives include lubricants, such as, a metal salt of a fatty acid (e.g., zinc or calcium stearate) or long chain alcohols, such as, UNILIN 700 available from Baker Petrolite and AEROSIL R972® available from Degussa. The coated silicas of U.S. Pat. Nos. 6,190,815 and 6,004,714, the disclosure of each of which hereby is incorporated by reference in entirety, also can be present. The additive can be present in an amount of from about 0.05 to about 5%, and in embodiments, of from about 0.1 to about 2% of the toner, which additives can be added during the aggregation or blended into the formed toner product.

Silica, for example, can enhance toner flow, tribo control, admix control, improved development and transfer stability and higher toner blocking temperature. Zinc, calcium or magnesium stearate also can provide developer conductivity, tribo enhancement, higher toner charge and charge stability. The external surface additives can be used with or without a coating or shell.

The gloss of a toner may be influenced by the amount of retained metal ion, such as, $Al^{3+}$, in a particle. The amount of retained metal ion may be adjusted further by the addition of a chelator, such as, EDTA. In embodiments, the amount of retained catalyst, for example, $Al^{3+}$, in toner particles of the present disclosure may be from about 0.1 pph to about 1 pph, in embodiments, from about 0.25 pph to about 0.8 pph. The gloss level of a toner of the instant disclosure may have a gloss, as measured in gloss units (gu), of from about 20 gu to about 100 gu, in embodiments, from about 50 gu to about 95 gu, in embodiments, from about 60 gu to about 90 gu. Gloss can be assessed by using a toner to produce an image, for example, using a conventional photocopier and commercially available stationery paper, and using a gloss meter (for example, BYK, Columbia, Md.) to determine the level of gloss of the fused toner image on the paper.

Hence, a particle can contain at the surface one or more silicas, one or more metal oxides, such as, a titanium oxide and a cerium oxide, a lubricant, such as, a zinc stearate and so on. In some embodiments, a particle surface can comprise two silicas, two metal oxides, such as, titanium oxide and cerium oxide, and a lubricant, such as, a zinc stearate. All of those surface components can comprise about 5% by weight of a toner particle weight. There can also be blended with the toner compositions, external additive particles including flow aid additives, which additives may be present on the surface of the toner particles. Examples of these additives include metal oxides like titanium oxide, tin oxide, mixtures thereof, and the like; colloidal silicas, such as AEROSIL®, metal salts and metal salts of fatty acids, including zinc stearate, aluminum oxides, cerium oxides, and mixtures thereof. Each of the external additives may be present in embodiments in amounts of from about 0.1 to about 5 wt %, or from about 0.1 to about 1 wt %, of the toner. Several of the aforementioned additives are illustrated in U.S. Pat. Nos. 3,590,000, 3,800,588, and 6,214,507, the disclosure of each of which is incorporated herein by reference.

A desirable characteristic of a toner is sufficient release of the paper image from the fuser roll. For oil containing fuser rolls, the toner may not contain a wax. However, for fusers without oil on the fuser (usually hard rolls), the toner will usually contain a lubricant like a wax to provide release and stripping properties. Thus, a toner characteristic for contact fusing applications is that the fusing latitude, that is, the temperature difference between the minimum fixing temperature (MFT) and the hot offset temperature, should be from about 50° C. to about 100° C., from about 75° C. to about 100° C., from about 80° C. to about 100° C. and from about 90° C. to about 95° C.

For the evaluation of toner particles, the parent charge can be measured by conditioning the toner at a specific TC (toner concentration, e.g., 8%) with a standard carrier, such as, a 35 μm Xerox DocuColor 2240 carrier, in both the A-zone and C-zone overnight, followed by charge evaluation after either 2 minutes or 60 minutes of mixing on a Turbula mixer. Humidity sensitivity is an important charging property for EA toners. The quantity of charge is a value measured through image analysis of the charge-spectrograph process (CSG). Toner charge-to-diameter ratios (q/d) in C- and A-zones, typically with a unit of femtocoulombs/(mm), can be measured on a known standard charge spectrograph. Furthermore, the tribo blow-off q/m values in μC/g may be measured using a blow-off method with a Barbetta Box. A prescribed amount of toner is blended with the carrier. The blending is performed, for example, by a paint shaker in glass jars or may be performed in a Turbula. The blending of the toner and carrier components results in an interaction, where toner particles become negatively charged and carrier particles become positively charged. Samples of the resulting mixture are loaded into a Robot Cage and weighed. Via instrument air and a vacuum source, the toner is removed from the carrier, while the carrier is retained by the screened Robot Cage. The residual charge on the carrier is detected by an electrometer in coulombs (relating to Tribo). The residual charge and the weight of toner blown off can be used to calculate the Tribo. Using the weights of toner blown off and retained carrier, the toner concentration can be calculated.

Toners may possess suitable charge characteristics when exposed to extreme relative humidity (RH) conditions. The low humidity zone (C zone) may be about 10° C. and 15% RH, while the high humidity zone (A zone) may be about 28° C. and 85% RH.

Toners of the instant disclosure also may possess a parent toner charge per mass ratio (q/m) of from about −5 μC/g to about −90 μC/g, and a final toner charge after surface additive blending of from about −15 μC/g to about 80 μC/g. Toners of interest have reduced q/d variation.

Other desirable characteristics of a toner include storage stability, particle size integrity, high rate of fusing to the substrate or receiving member, sufficient release of the image from the photoreceptor, nondocument offset, use of smaller-sized particles and so on, and such characteristics can be obtained by including suitable reagents, suitable additives or both, and/or preparing the toner with particular protocols.

The dry toner particles, exclusive of external surface additives, may have the following characteristics: (1) volume average diameter (also referred to as "volume average particle diameter") of from about 2.5 to about 20 μm, in embodiments, from about 2.75 to about 10 μm, in embodiments, from about 3 to about 7.5 μm; (2) number average geometric standard deviation ($GSD_n$) and/or volume average geometric standard deviation ($GSD_v$) of from about 1.18 to about 1.30, in embodiments, from about 1.21 to about 1.24; and (3) circularity of from about 0.9 to about 1.0 (measured with, for example, a Sysmex FPIA 2100 analyzer), in embodiments, from about 0.95 to about 0.985, in embodiments, from about 0.96 to about 0.98.

III. Developers

A. Composition

The toner particles thus formed may be formulated into a developer composition. For example, the toner particles may be mixed with carrier particles to achieve a two component developer composition. The toner concentration in the developer may be from about 1% to about 25% by weight of the total weight of the developer, in embodiments, from about 2% to about 15% by weight of the total weight of the developer, with the remainder of the developer composition being the carrier. However, different toner and carrier percentages may be used to achieve a developer composition with desired characteristics.

1. Carrier

Examples of carrier particles for mixing with the toner particles include those particles that are capable of triboelectrically obtaining a charge of polarity opposite to that of the toner particles. Illustrative examples of suitable carrier particles include granular zircon, granular silicon, glass, steel, nickel, ferrites, iron ferrites, silicon dioxide, one or more polymers and the like. Other carriers include those disclosed in U.S. Pat. Nos. 3,847,604; 4,937,166; and 4,935,326.

In embodiments, the carrier particles may include a core with a coating thereover, which may be formed from a polymer or a mixture of polymers that are not in close proximity thereto in the triboelectric series, such as, those as taught herein or as known in the art. The coating may include fluoropolymers, such as polyvinylidene fluorides, terpolymers of styrene, methyl methacrylates, silanes, such as triethoxy silanes, tetrafluoroethylenes, other known coatings and the like. For example, coatings containing polyvinylidenefluoride, available, for example, as KYNAR 301F™, and/or polymethylmethacrylate (PMMA), for example, having a weight average molecular weight of about 300,000 to about 350,000, such as, commercially available from Soken, may be used. In embodiments, PMMA and polyvinylidenefluoride may be mixed in proportions of from about 30 to about 70 wt % to about 70 to about 30 wt %, in embodiments, from about 40 to about 60 wt % to about 60 to about 40 wt %. The coating may have a coating weight of, for example, from about 0.1 to about 5% by weight of the carrier, in embodiments, from about 0.5 to about 2% by weight of the carrier.

In embodiments, PMMA, for example, may be copolymerized with any desired monomer, so long as the resulting copolymer retains a suitable particle size. Suitable monomers include monoalkyl or dialkyl amines, such as, a dimethylaminoethyl methacrylate, diethylaminoethyl methacrylate, diisopropylaminoethyl methacrylate or butylaminoethyl methacrylate, and the like.

Various effective suitable means can be used to apply the polymer to the surface of the carrier core, for example, cascade roll mixing, tumbling, milling, shaking, electrostatic powder cloud spraying, fluidized bed mixing, electrostatic disc processing, electrostatic curtain processing, combinations thereof and the like. The mixture of carrier core particles and polymer then may be heated to enable the polymer to melt and to fuse to the carrier core. The coated carrier particles then may be cooled and thereafter classified to a desired particle size.

The carrier particles may be prepared by mixing the carrier core with polymer in an amount from about 0.05 to about 10% by weight, in embodiments, from about 0.01 to about 3% by weight, based on the weight of the coated carrier particle, until adherence thereof to the carrier core is obtained, for example, by mechanical impaction and/or electrostatic attraction.

In embodiments, suitable carriers may include a steel core, for example, of from about 25 to about 100 μm in size, in embodiments, from about 50 to about 75 μm in size, coated with about 0.5% to about 10% by weight, in embodiments, from about 0.7% to about 5% by weight of a polymer mixture including, for example, methylacrylate and carbon black, using the process described, for example, in U.S. Pat. Nos. 5,236,629 and 5,330,874.

IV. Devices Comprising a Toner Particle

Toners and developers can be combined with a number of devices ranging from enclosures or vessels, such as, a vial, a bottle, a flexible container, such as a bag or a package, and so on, to devices that serve more than a storage function.

A. Imaging Device Components

The toner compositions and developers of interest can be incorporated into devices dedicated, for example, to delivering same for a purpose, such as, forming an image. Hence, particularized toner delivery devices are known, see, for example, U.S. Pat. No. 7,822,370, and can contain a toner preparation or developer of interest. Such devices include cartridges, tanks, reservoirs and the like, and can be replaceable, disposable or reusable. Such a device can comprise a storage portion; a dispensing or delivery portion; and so on; along with various ports or openings to enable toner or developer addition to and removal from the device; an optional portion for monitoring amount of toner or developer in the device; formed or shaped portions to enable siting and seating of the device in, for example, an imaging device; and so on.

B. Toner or Developer Delivery Device

A toner or developer of interest may be included in a device dedicated to delivery thereof, for example, for recharging or refilling toner or developer in an imaging device component, such as, a cartridge, in need of toner or developer, see, for example, U.S. Pat. No. 7,817,944, wherein the imaging device component may be replaceable or reusable.

V. Imaging Devices

The toners or developers can be used for electrostatographic or electrophotographic processes, including those disclosed in U.S. Pat. No. 4,295,990, the disclosure of which hereby is incorporated by reference in entirety. In embodiments, any known type of image development system may be used in an image developing device, including, for example, magnetic brush development, jumping single component development, hybrid scavengeless development (HSD) and the like. Those and similar development systems are within the purview of those skilled in the art.

Imaging processes include, for example, preparing an image with an electrophotographic device including, for example, one or more of a charging component, an imaging component, a photoconductive component, a developing component, a transfer component, a fusing component and so on. The electrophotographic device may include a high speed printer, a color printer and the like.

Once the image is formed with toners/developers via a suitable image development method, such as any of the aforementioned methods, the image then may be transferred to an image receiving medium or substrate, such as, a paper and the like. In embodiments, the fusing member or component, which can be of any desired or suitable configuration, such as, a drum or roller, a belt or web, a flat surface or platen, or the like, may be used to set the toner image on the substrate. Optionally, a layer of a liquid, such as, a fuser oil can be applied to the fuser member prior to fusing.

Color printers commonly use four housings carrying different colors to generate full color images based on black plus the standard printing colors, cyan, magenta and yellow. However, in embodiments, additional housings may be desirable, including image generating devices possessing five housings, six housings or more, thereby providing the ability to carry additional toner colors to print an extended range of colors (extended gamut).

The following Examples illustrate embodiments of the instant disclosure. The Examples are intended to be illustrative only and are not intended to limit the scope of the present disclosure. Parts and percentages are by weight unless otherwise indicated. As used herein, "room temperature," (RT) refers to a temperature of from about 20° C. to about 30° C.

EXAMPLES

Example 1

Bench Scale Toner Particle Preparation

In a 2 L reactor, 198 g of a 1:1 mixture of two amorphous resins (polyester A ($M_w$=86,000, $T_g$ onset=56° C., 35% solids) and polyester B ($M_w$=19,400, $T_g$ onset=60° C., 35% solids)), 34 g crystalline polyester C ($M_w$23,300, $M_n$=10,500, Tm=71° C., 35% solids), 2% surfactant (DOWFAX® 3A1, Dow Chemical Company), 50 g polyethylene wax emulsion ($T_m$=90° C., 30% solids, The International Group, Inc. (IGI)), 96 kg black pigment (Nipex 35, Evonik Industries, Essen, Del.) and 16 g pigment PB 15:3 dispersion were mixed with 511 g of deionized water in a reactor. The toner slurry was adjusted to pH adjusted to 4.2 using 0.3 M nitric acid. Subsequently, 0.5 pph of aluminum sulphate solution were added during homogenization at 3000-4000 RPM drop-wise over a period of 5 minutes. The reactor was set to 500 RPM and was heated to 42° C. to aggregate the toner particles. When the targeted particle size of 4.8 μm was achieved, a shell mixture of 167 g of the amorphous resins in 31 g of DI water was added to the mixture. The reaction was then heated to 46° C. When the toner particle size of 5.3 μm was obtained, coalescence was stopped by lowering the pH of the slurry to 4.5 using a 4% NaOH solution. The reactor stir rate was decreased to 200 rpm, followed by the addition of EDTA and more NaOH solution until the pH reached 7.8. The reactor temperature was ramped to the desired coalescence temperature as described in Table 1. Once at the desired temperature, the pH was adjusted to between pH 7.0 to 5.9 using pH 5.7 sodium acetate buffer solution to spheroidize the particles. After about 90 minutes, the target circularity was achieved (>0.965) and the slurry was cooled using a heat exchanger. Slow cooling occurred with a temperature reduction of about 0.75° C./min. Quench cooling occurred with a temperature reduction of about 1° C./min. The varying coalescence conditions are detailed in Table 1.

TABLE 1

Toner Conditions

| | Toner ID | | | | |
|---|---|---|---|---|---|
| | 2 | 3 | 4 | 5 | 6 |
| Coalescence Temp ° C. | 85 | 75 | 70 | 75 | 70 |
| $D50/GSD_v/GSD_n$ | 5.26/1.19/1.24 | 5.31/1.20/1.22 | 5.27/1.20/1.27 | 5.25/1.21/1.24 | 5.20/1.20/1.23 |
| Circularity | 0.972 | 0.965 | 0.967 | 0.964 | 0.964 |
| Cooling | Slow | Slow | Slow | Quench | Quench |

Example 2

Charging and Dielectric Loss

Dielectric loss was determined by creating a toner pellet in a custom-made fixture. The toner sample was placed in a mold with a spring-loaded 2-in diameter precision-ground plunger and was pressed at about 2000 psi for 2 minutes. While maintaining contact with the plunger (which acts as one electrode), the pellet is then forced out of the mold onto a spring-loaded support, which keeps the pellet under pressure and also acts as the counter electrode. Using an HP4263B LCR Meter via shielded 1 meter BNC cables, dielectric and dielectric loss were determined by measuring the capacitance (Cp) and the loss factor (D) at 100 KHz frequency and 1 VAC. The dielectric constant was calculated as: $E'=[Cp\ (pF)\times Thickness\ (mm)]/[8.854\times A_{effective}\ (m^2)]$. The value, 8.854, is the vacuum electrical permittivity, epsilon (∈), but in units that take into account that Cp is in picofarads, not farads, and thickness is in mm and not in meters. $A_{effective}$ is the effective area of the sample. Dielectric loss is equal to E*Dissipation factor, which is how much electrical dissipation there is in the sample, that is, how leaky the capacitor is. That is multiplied by 1000 to simplify the values. Thus, a reported dielectric loss value of 70 indicates a measured dielectric loss of $70\times10^{-3}$, or 0.070.

Charging was carried out using standard procedures (see, e.g., U.S. Pat. No. 7,574,128, herein incorporated by reference in entirety). Developer samples were prepared with 0.5 g of the toner and 10 g of a 35 μm polymer-coated ferrite carrier. A duplicate developer sample pair was prepared. Developer was conditioned overnight in the A-zone (28° C./85% RH) or in the C-zone environment chamber (10° C./15% RH). The next day, the developer samples were sealed and agitated for 2 minutes and then 1 hour using a TURBULA mixer. After 2 minutes and 1 hour of mixing, the toner tribo charge was measured using a charge spectrograph in a 100 V/cm field. The toner charge (q/d) was measured visually as the midpoint of the toner charge distribution. The charge was reported in millimeters of displacement from the zero line. The charge in mm displacement can be converted to femtocoulombs/μm (fC/μm) by multiplying the value by 0.092. Following 1 hr of mixing, an additional 0.5 g of toner sample were added to the already charged developer and mixed for a further 15 seconds, where a q/d displacement again was measured, and then mixed for an additional 45 seconds (total mixing time of 1 minute), and again a q/d displacement was measured.

The charging and dielectric loss data presented in Table 2 reveal that reducing coalescence temperature reduces dielectric loss. Dielectric loss is reduced further when the toner also is quenched. Also charging was improved.

TABLE 2

Charging and Dielectric Loss Data.

| | 60' Additive Charge | | | | 10' Parent B Zone | | E'' * |
|---|---|---|---|---|---|---|---|
| | q/d (mm) | | Tribo (μC/g) | | q/d | Tribo | 1000 |
| Particle | A zone | C zone | A zone | C zone | (mm) | (μC/g) | (loss) |
| 2 | −4.3 | −8.1 | 29 | 58 | −6.8 | 45 | 127 |
| 3 | −3.2 | −7.1 | 24 | 47 | −7.8 | 53 | 102 |
| 4 | −3.9 | −7.9 | 26 | 51 | −6.8 | 60 | 89 |
| 5 | −3.8 | −9.6 | 28 | 64 | −9.4 | 66 | 50 |
| 6 | −3.9 | −9.6 | 32 | 63 | −11.3 | 78 | 46 |

The dielectric loss values for hyperpigmented black toners approach that of non-hyperpigmented black toners (~34). Along with the improvement in dielectric loss, improvement in toner charge also was observed.

Example 3

Twenty Gallon Toner Preparation

A black polyester EA toner was prepared at using the same ingredients as used for the bench scale toner with the reagents used in the same ratios or relative amounts. The slurry was homogenized through a CAVITRON homogenizer with the use of a recirculating loop for a total of 60 minutes, where in the first 8 minutes, the coagulant consisting of 2.96 g aluminum sulphate mixed with 36.5 g DI water was added inline. The reactor rpm was increased from 100 rpm to set mixing at 300 rpm once all of the coagulant was added. The slurry was then aggregated at a batch temperature of 42° C. During aggregation, a shell formulation comprised of the same amorphous resins as in the core was pH adjusted to 3.3 with nitric acid and was added to the batch. The batch may be further heated to achieve the targeted particle size. Once at the target particle size, pH was adjusted to 7.8 using sodium hydroxide (NaOH) and EDTA to freeze aggregation. The process was continued with the reactor temperature (Tr) being increased to achieve the desired temperature (See Table 3) and the pH was adjusted to 6.8-6.0 using pH 5.7 sodium acetate/acetic acid buffer where the particles began to coalesce. After two hours, the particles achieved a circularity of >0.965 and were quench cooled using a heat exchanger at about 1° C./min. The toners were washed with three DI water washes at room temperature and dried using an ALJET THERMAJET dryer Model 4.

TABLE 3

| 20 Gallon Toners | | | | | | |
|---|---|---|---|---|---|---|
| | $D50/GSD_v/GSD_n$ | Circ | Coalescence temperature | Dielectric Loss | $2^{nd}$ Transfer efficiency | Mottle (A-zone 8% TC 100% patch) |
| 7 (Control) | 5.31/1.22/1.23 | 0.969 | 85° C. | 81 | 57.25 | 100 |
| 8 (Exp.) | 5.37/1.22/1.26 | 0.968 | 70° C. | 54 | 69.75 | 45 |

Toner preparation was scaled to 20 gallons and again, the toner prepared employing a lowered coalescence temperature and quench cooling (8) showed improved dielectric loss, $2^{nd}$ transfer efficiency and mottle.

The ICP and XPS data summarized in Table 4 reveals that fewer sodium ions were in the toner bulk and at the toner surface, respectively, with reduced coalescence temperature and quench cooling, and it has been suggested that reducing sodium ion contact on the toner surface can contribute to better toner charging.

TABLE 4

| Induced Coupled Plasma (ICP) and X-ray Photoelectron Spectroscopy (XPS) of Toner | | | | |
|---|---|---|---|---|
| Toner | Coal. Temp | Cooling | ICP Bulk Na [ppm] | Atom % Surface Na by XPS |
| 7 | 85° C. | Quench | 1802 | 0.24 |
| 8 | 70° C. | Quench | 919 | 0.06 |
| 2 | 85° C. | Slow | 1708 | 0.29 |
| 3 | 75° C. | Slow | 1104 | 0.14 |
| 4 | 70° C. | Slow | 633 | 0.10 |
| 5 | 75° C. | Quench | 971 | 0.23 |
| 6 | 70° C. | Quench | 813 | 0.19 |

It will be appreciated that several of the above-disclosed and other features and functions, or alternatives thereof, may be desirably combined into many other different systems or applications. Also various presently unforeseen or unanticipated alternatives, modifications, variations or improvements therein may be subsequently made by those skilled in the art, which are also intended to be encompassed by the following claims. Unless specifically recited in a claim, steps or components of claims should not be implied or imported from the specification or any other claims as to any particular order, number, position, size, shape, angle, color or material.

All references cited herein are herein incorporated by reference in their entireties.

We claim:

1. A method of producing emulsion aggregation toner particles comprising:

combining a first amorphous resin, an optional second amorphous resin, an optional crystalline resin, an optional surfactant, a wax, an optional conductive colorant, and optionally one or more other pigments in a mixture;

aggregating said mixture to form aggregated particles;

optionally adding a resin emulsion to form a shell over the aggregated particles;

coalescing said particles at a temperature lower than the melting point of said optional crystalline resin and said wax; and quench cooling said particles to obtain said toner particles comprising a dielectric loss of less than about 70 and a bulk sodium ion concentration of less than about 1100 ppm.

2. The method of claim 1, comprising a crystalline resin.

3. The method of claim 1, wherein said toner particles have lower dielectric loss as compared to toner produced at a higher coalescing temperature, slow cooled or both.

4. The method of claim 1, wherein said coalescing temperature is less than about 80° C.

5. The method of claim 1, wherein the toner particles comprise reduced q/d variation.

6. The method of claim 1, wherein the bulk sodium ion concentration of the toner particles is less than about 1000 ppm.

7. The method of claim 1, wherein said shell comprises at least about 20% by weight of the toner particle.

8. The method of claim 1, wherein the toner particles comprise a surface sodium ion concentration of less than about 0.25 atom %.

9. The method of claim 1, wherein said conductive colorant comprises a black pigment.

10. A toner produced by the method of claim 1, comprising greater than about 6 wt % of a conductive colorant, said toner comprising a dielectric loss is less than about 70 and a bulk sodium ion concentration of less than about 1100 ppm.

11. The toner of claim 10, wherein said toner comprises a shell present at about 20% to about 40% by weight of dry toner.

12. The toner of claim 10, wherein said conductive colorant comprises a black pigment.

13. An emulsion aggregation toner comprising greater than about 6 wt % of a conductive colorant, said toner comprising a dielectric loss is less than about 70 and a bulk sodium ion concentration of less than about 1100 ppm.

14. The toner of claim 13, comprising a surface sodium ion concentration of less than about 0.25 atom %.

15. The toner of claim 13, wherein said conductive colorant comprises a black pigment.

16. The toner of claim 13 comprising a crystalline resin, a wax or both.

17. The toner of claim 13, comprising a shell of at least about 20% by weight of the toner particle.

* * * * *